United States Patent [19]

Proud et al.

[11] 4,427,924

[45] Jan. 24, 1984

[54] ENHANCED ELECTRODELESS LIGHT SOURCE

[75] Inventors: Joseph M. Proud, Wellesley Hills; Walter P. Lapatovich, Watertown; Stephen G. Johnson, Georgetown, all of Mass.

[73] Assignees: GTE Laboratories Inc., Waltham, Mass.; GTE Products Corp., Stamford, Conn.

[21] Appl. No.: 307,568

[22] Filed: Oct. 1, 1981

[51] Int. Cl.[3] ..... H05B 41/16; H05B 41/24

[52] U.S. Cl. ..... 315/248; 315/39; 313/638; 313/639

[58] Field of Search ..... 315/248, 39; 313/227, 313/228, 229, 637, 638, 639, 640, 641

[56] References Cited

U.S. PATENT DOCUMENTS

| | | | |
|---|---|---|---|
| 2,103,038 | 12/1937 | Moers | 313/228 X |
| 3,234,421 | 2/1966 | Reiling | 313/25 |
| 3,319,119 | 5/1967 | Rendina | 315/248 |

*Primary Examiner*—Saxfield Chatmon

*Attorney, Agent, or Firm*—David M. Keay

[57] ABSTRACT

A source of visible light including an electrodeless lamp containing a mercury halide, iodine, and nitrogen. When the contents of the electrodeless lamp are excited by high frequency power, visible light is emitted.

4 Claims, 2 Drawing Figures

ENHANCED ELECTRODELESS LIGHT SOURCE

CROSS-REFERENCE TO RELATED APPLICATIONS

This application is related to subject matter described in application Ser. No. 307,419 filed concurrently herewith by Joseph M. Proud and Stephen G. Johnson entitled "Electrodeless Ultraviolet Light Source," and in application Ser. No. 307,420 filed concurrently herewith by Joseph M. Proud and Stephen G. Johnson entitled "Electrodeless Light Source."

BACKGROUND OF THE INVENTION

This invention relates to electromagnetic discharge apparatus. More particularly, it is concerned with electrodeless sources of light.

Electrodeless light sources which operate by coupling high frequency power to a glow discharge in an electrodeless lamp have been developed. These light sources typically include a high frequency power source connected to a coupling fixture having an inner conductor and an outer conductor disposed around the inner conducter. The electrodeless lamp is positioned adjacent to the end of the inner conductor. High frequency power is coupled to a light emitting electromagnetic discharge within the electrodeless lamp. A portion of the coupling fixture passes radiation at the wavelengths of the light produced, thus permitting the use of the apparatus as a light source.

SUMMARY OF THE INVENTION

It is an object of the present invention to provide an improved electromagnetic discharge apparatus.

It is another object of the invention to provide an electrodeless lamp which serves as a source of visible light.

An improved light source is provided by electromagnetic discharge apparatus in accordance with the present invention. The apparatus comprises an electrodeless lamp having an envelope made of a light transmitting material. The fill material within the envelope comprises a mercury halide, iodine, and nitrogen. Means are provided for coupling high frequency power to the fill material within the envelope to vaporize and excite the fill material whereby the fill material emits light.

The mercury halide, nitrogen, and iodine are all excited by the applied radio frequency energy. In accordance with the teachings in application Ser. No. 307,420 the mercury halide molecule ($HgX_2$) is dissociated to leave a monohalide (HgX) in an excited state. When the monohalide molecule undergoes a transition from the excited state to a lower state it radiates light. Iodine molecules are also dissociated to form iodine atoms, some which are excited to produce ultraviolet radiation upon transition from higher to lower energy states as taught in application Ser. No. 307,419. The presence of the ultraviolet radiation further disociatvely excites the mercury halide causing an increased population of mercury monohalide (HgX) molecules in the excited state. Nitrogen is also excited in the discharge to high energy states which include the long lived metastable state of the nitrogen molecule. Collisions between nitrogen metastables and the mercury halide molecules ($HgX_2$) result in resonant energy transfer which dissociatively excites the halide molecule further enhancing the population of excited mercury monohalide (HgX) molecules. Thus the various constituents of the electronic discharge further enhance the basic mechanism of the excitation of the mercury halide by the applied RF energy.

For a better understanding of the present invention, together with other and further objects, advantages, and capabilities thereof, reference is made to the following discussion and appended claims in connection with the above-described drawings.

DETAILED DESCRIPTION OF THE INVENTION

Figure 1:
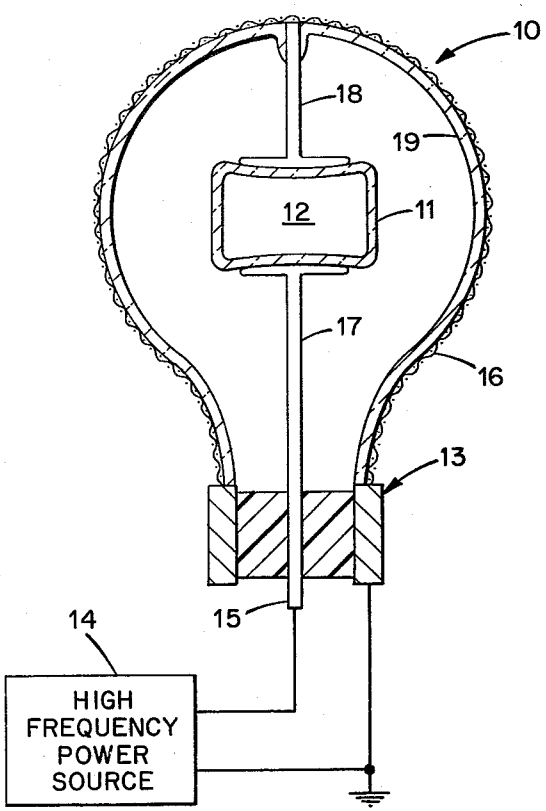
FIG. 1 is a schematic representation of an electrodeless radio frequency coupled discharge light source in accordance with one embodiment of the present invention.

One embodiment of an electromagnetic discharge apparatus in accordance with the present invention is illustrated in FIG. 1. The apparatus 10 includes an electrodeless lamp 11 containing a fill material 12. The electrodeless lamp 11 is supported within a coupling fixture 13 which couples power from a high frequency power source 14 to the fill material of the electrodeless lamp. The electrodeless lamp forms a termination load for the fixture.

The electrodeless lamp 11 has a sealed envelope made of a suitable material which is transparent to visible light, for example, fused silica, aluminum oxide, or Pyrex. The fill material within the lamp envelope in accordance with the present invention includes a metal halide, iodine, and nitrogen gas. The fill material preferably consists of 1 to 10 mg of mercury halide, 1 to 0 torr of nitrogen, and 0.1 to 0.2 mg iodine. At typical operating temperatures for the lamp, about 135° C., the density of iodine is saturated and an excess quantity of mercury halide is ensured.

The coupling fixture 13 includes an inner conductor 15 and an outer conductor 16 disposed around the inner conductor. The outer conducter 16 includes a conductive mesh which acts as a conductor and provides shielding at the operating frequencies while permitting the passage of light radiated from the lamp 11. The electrodeless lamp 11 is supported between a first metal electrode 17 at one end of the inner conductor 15 and a second metal electrode 18 connected to the outer conductor 16. The other ends of the inner and outer conductors are arranged in a coaxial configuration for coupling to the power source 14. The outer conductive mesh is supported by a transparent envelope 19, which may be of glass. The outer envelope 19 prevents personal contact with the hot inner electrodeless lamp 11 and also prevents excess loss of heat from the electrodeless lamp.

In order to achieve electrodeless discharge, it is necessary to employ RF power capable of penetrating the lamp envelope while being absorbed strongly in the low pressure discharge plasma contained therein. The power source 14 preferably is a source of continuous wave RF excitation in the range of from 902 to 928 MHz, although frequencies of 1 MHz to 10 GHz may be used. Structural details of electromagnetic discharge apparatus as illustrated schematically in FIG. 1 are disclosed in application Ser. No. 307,418 filed concurrently herewith by Joseph M. Proud, Robert K. Smith, and Charles N. Fallier entitled "Electromagnetic Discharge Apparatus."

When high frequency power is applied to an electrodeless lamp containing a fill of mercury halide, iodine, and nitrogen as described, a discharge is initiated in the nitrogen gas which warms the contents of the lamp causing an increase in the vapor pressure of the mercury halide and the iodine. The fill material is thus vaporized and excited and the excited constituents of the fill cooperate to produce a desirable spectrum of visible light. Mercuric chloride and mercuric bromide are preferred as the mercury halide.

As described in application Ser. No. 307,420 visible emission is produced by electronic excitation of mercury halide in a discharge. This reaction may be expressed as $$HgX_2+e^-\rightarrow HgX^*(B^2\Sigma^+)+X^-$$
$$+e^- HgX^*(B^2\Sigma^+)\rightarrow HgX(X^2\Sigma^+)+h\Delta\nu$$

where $h\Delta\nu$ represents light emitted in a broad band of frequencies. This reaction takes place when the kinetic energy of the impinging electron is sufficient to dissociate the parent molecule ($HgX_2$) and leave a fragment (HgX) in an excited state, the $B^2\Sigma+$ level. This state radiatively decays to the ground state ($X^2\Sigma+$) producing the observed spectrum.

When excited by the applied high frequency energy, some nitrogen gas is raised to the metastable $A^3\Sigma_u+$ state. In this state the nitrogen acts as an energy source for further driving the reaction of the mercury halide described hereinabove. The metastable state of the nitrogen gas is produced either by electronic discharge excitation or excitation transferred by collision with metastable argon atoms (if present) to higher excited electronic states which radiatively cascade into the metastable ($A^3\Sigma_u+$) state. By definition, the metastable state does not decay radiatively and hence stores energy (6.2 eV/molecule) which may be extracted in collissions with other species present in the discharge. Collisions between $N_2(A^3\Sigma_u+)$ and mercury halide ($HgX_2$) molecules provide the additional reaction:

$$HgX_2+N_2^*(A^3\Sigma_u+)\rightarrow HgX^*(B^2\Sigma+)+N_2(X^1\Sigma_g+)+X$$
$$HgX^*(B^2\Sigma+)\rightarrow HgX(X^2\Sigma+)+h\Delta\nu$$

The foregoing expressions indicate that the stored energy of the metastable nitrogen is extracted in a resonant energy transfer collision with a mercury halide molecule ($HgX_2$). The nitrogen metastable state yields 6.2 eV of stored energy and consequently deactivates into the ground state. Of the 6.2 eV of energy received by the mercury halide molecule ($HgX_2$), approximately 3.1 eV is required to dissociate the triatom ($HgX_2$into a diatom (HgX), and atom, (X). Some kinetic energy is carried away by the atom, but the remaining 3.1 eV is enough energy to excite the diatom (HgX) into the lowest radiating state ($B^2\Sigma+$). Because this resonance in energy exists, collisions between nitrogen in the excited state, $A^3\Sigma+$, and mercury halide ($HgX_2$) produce preferential fragments $HgX(B^2\Sigma+)$ as opposed to nonradiating $HgX(X^2\Sigma+)$ or dissociative $HgX(A^2\pi)$. Because the $HB^2\Sigma+$ state is populated in these collisions, substantial visible radiation from the $B^2\Sigma+\rightarrow X^2\Sigma+$ transition results. This effect is enhanced further since no radiation trapping occurs because the X state population is constantly depleted via vibrational relaxations and recombination with the atoms to produce mercury halide molecules ($HgX_2$) in the steady state.

Another reaction which may be occurring to produce the monochloride (HgX) radiating species is photodissociative excitation of the molecule ($HgX_2$). It is known that each dihalide has two broad absorption bands in the ultraviolet; one leading to dissociation of the molecule into nonradiating fragments, e.g., $HgX(X^2\Sigma+)+X$, and the other, at higher energy leading to the preferential dissociation into the radiating $B^2\Sigma+$ state.

As described in copending application Ser. No. 307,419 when atomic iodine is excited to a high energy level, it then radiates ultraviolet radiation at 206 nm when it is restored to the ground level. This radiation is effective in dissociating $HgX_2$ to the $B^2\Sigma+$ state through the reaction $$HgX_2+h\nu(206\text{ nm})\rightarrow HgX^*(B^2\Sigma+)+X$$
$$HgX^*(B^2\Sigma+)\rightarrow HgX(X^2\Sigma+)+h\Delta\nu$$

Thus atomic emission from the atomic iodine at 206 nm provides additional population of the radiating $B^2\Sigma+$ state of the monohalide.

In electromagnetic discharge apparatus as described employing an electrodeless lamp containing a mercury halide, iodine, and nitrogen the constituents cooperate to maximize the production of visible emission from the mercury halide. The mercury halide is excited to a high level monohalide which produces visible light upon photoemission transition from a high energy state to a lower energy state. In addition the iodine within the discharge vessel acts as a source of atomic ultraviolet radiation which further assists in the production of visible emission by exciting additional mercury halide molecules to the high energy monohalide state. The use of nitrogen gas as an energy reservoir buffer gas also contributes to the production of incoherent visible light by further enhancing the mercury monohalide population through resonant energy transfer collisions. The three reactions all contribute to the visible emission, and all three occur within the same discharge vessel thereby increasing the total light output. Since each of the reactions in itself is not 100% efficient, sufficient mercury halide in the vapor phase is ensured for all the reactions. Thus the addition of nitrogen and iodine to the mercury halide discharge maximizes the probability that mercury halide will be preferentially dissociated into the excited diatomic $B^2\Sigma+$ state which subsequently radiates. The visible broad band radiation from the $B^2\Sigma+\rightarrow X^2\Sigma+$ transition is thus enhanced.

Figure 2:
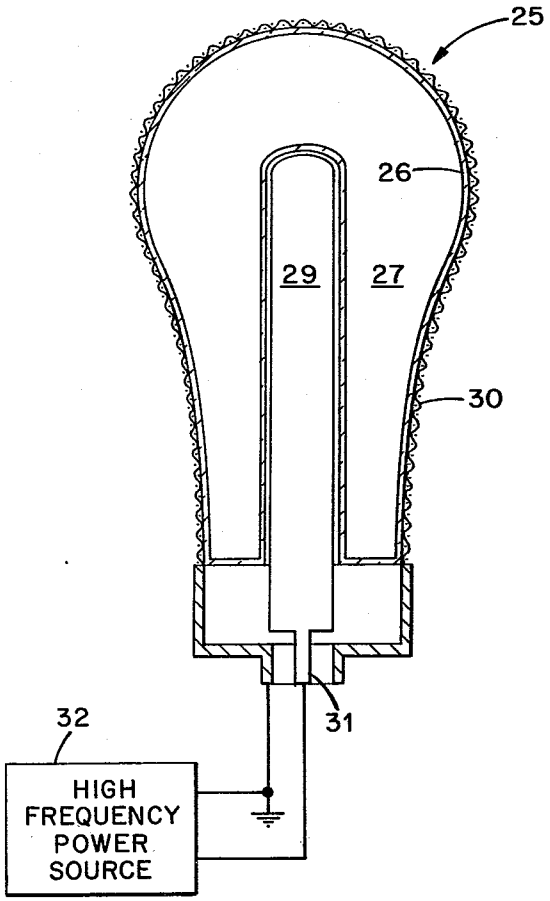
FIG. 2 is a representation of an alternative form of electromagnetic discharge apparatus in accordance with the present invention.

FIG. 2 illustrates an alternative embodiment of an electromagnetic discharge apparatus 25 in accordance with the present invention. The apparatus 25 includes an electrodeless lamp 26 having an envelope in the shape of a reentrant cylinder, providing a generally annular discharge region 27. The fill material of the lamp includes the combination of mercury halide, iodine, and nitrogen as described hereinabove with respect to the embodiment of FIG. 1. The RF coupling arrangement includes a center electrode 29 disposed within the internal reentrant cavity in the envelope 26. An outer conductive mesh 30 surrounds the envelope 26 providing an outer electrode transparent to radiation from the lamp. The center electrode 29 and outer mesh 30 are coupled by a suitable coaxial arrangement 31 to a high frequency power source 32. A radio frequency electric field is produced between the center electrode 29 and the outer mesh 30 causing ionization and breakdown of the fill material 27. Visible light is produced by the resulting glow discharge within the lamp as explained in detail hereinabove. The specific details of the structure of apparatus of this general type are shown in U.S. Pat. No. 4,266,167 which issued May 5, 1981 to Joseph M. Proud and Donald H. Baird entitled "Compact Fluorescent Light Source and Method of Excitation Thereof."

While there has been shown and described what are considered preferred embodiments of the present invention, it will be obvious to those skilled in the art that various changes and modifications may be made therein without departing from the invention as defined by the appended claims.

What is claimed is:

1. An electromagnetic discharge apparatus comprising an electrodeless lamp having an envelope made of a light transmitting material;

a fill material within said envelope consisting essentially of a mixture of a mercury halide, iodine, and nitrogen; and means for coupling high frequency power to the fill material within the envelope to vaporize and excite the fill material whereby the fill material emits light.

2. An electromagnetic discharge apparatus in accordance with claim 1 wherein said mercury halide is selected from the group consisting of mercuric chloride and mercuric bromide.

3. An electromagnetic discharge apparatus in accordance with claim 1 wherein said fill material contains a mercury halide, iodine, and nitrogen in the ratio of 1 to 10 milligrams of mercury halide, 0.1 to 0.2 milligrams of iodine, and 1 to 10 torr nitrogen.

4. An electromagnetic discharge apparatus comprising an electrodeless lamp having an envelope made of a light transmitting material enclosing a fill material; and means for coupling high frequency power to the fill material within the envelope;

the fill material consisting essentially of a mercury halide, nitrogen, and a source of iodine atoms which are excited to a high energy state when high frequency power is applied;

whereby the fill material emits light when high frequency power is applied thereto.

* * * * *